United States Patent [19]

Gross

[11] Patent Number: 4,856,216

[45] Date of Patent: Aug. 15, 1989

[54] ADVERTISING COVER FOR FLUORESCENT LIGHTING

[76] Inventor: Jan S. Gross, P.O. Box 5117, St. Augustine, Fla. 32085

[21] Appl. No.: 125,946

[22] Filed: Nov. 27, 1987

Related U.S. Application Data

[63] Continuation-in-part of Ser. No. 864,548, May 19, 1986, Pat. No. 4,716,671.

[51] Int. Cl.[4] ..... G09F 13/02

[52] U.S. Cl. ..... 40/559; 40/518; 40/558; 40/600

[58] Field of Search ..... 40/518, 558, 553, 576, 40/575, 600, 559

[56] References Cited

U.S. PATENT DOCUMENTS

| | | | |
|---|---|---|---|
| 2,127,997 | 8/1938 | Huston et al. | 40/518 |
| 3,984,931 | 10/1976 | Belokin, Jr. | 40/600 |
| 4,075,775 | 2/1978 | Shorette | 40/553 |
| 4,136,474 | 1/1979 | Belokin, Jr. | 40/558 |
| 4,290,218 | 9/1981 | Drueck, Jr. | 40/553 |
| 4,528,764 | 7/1985 | Cobb | 40/558 |

*Primary Examiner*—Gene Mancene

*Assistant Examiner*—Cary E. Stone

*Attorney, Agent, or Firm*—Arthur G. Yeager

[57] ABSTRACT

Decorative advertising cover for overhead fluorescent strip lighting, the cover having the general shape of a triangular prism, the cover including two rectangular sheets of flexible transparent plastic having two opposite sides slidingly engaged in channel recesses in two opaque triangular end caps having a top edge to fit closely adjacent a ceiling to which the fluorescent lighting fixture is attached and two side edges joined in a rounded corner opposite to the top edge, a cutout portion in the central portion of the top edge and extending downwardly to fit closely adjacent the outside perimeter of a fluorescent strip lighting fixture, laterally slidable finger means to engage the upper side of the fluorescent lighting fixture to support the cover, laterally movable magnet means mounted on opposite sides of the cutout portion to fasten themselves to the vertical sides of the fluorescent lighting fixture by magnetic attraction, three corner spacer members to join the respective corners of the two end caps and having channel recesses to receive edges of the transparent plastic sheets, and a second set of channel recesses to receive a plastic sheet with advertising printed thereon.

21 Claims, 5 Drawing Sheets

ADVERTISING COVER FOR FLUORESCENT LIGHTING

RELATED PATENT APPLICATIONS

This is a continuation-in-part of my copending patent application Ser. No. 864,548 filed May 19, 1986, now U.S. Pat. No. 4,716,671.

BACKGROUND OF THE INVENTION

Advertising material is displayed inside sales rooms in retail stores and markets in a variety of ways. One of the most desirable procedures is to use a lighted sign because of its eye-catching capabilities. Generally, however, such lighted signs are specially designed items, separate from the illumination for the room, and somewhat expensive to purchase, install, and maintain. The use of the illumination lighting for advertising purposes has not been considered practical because the reduced illumination in the room was not acceptable. Nevertheless, the possibility of using the illumination lighting for advertising in a low cost acceptable manner has remained in the minds of marketing people as a desirable solution to some of their needs.

In my copending patent application, Ser. No. 864,548 filed May 19, 1986, there is shown an advertising cover for these purposes. The present application provides an improved advertising cover having several novel features.

It is an object of this invention to provide a novel advertising cover for fluorescent lighting. It is another object of this invention to provide a light weight, inexpensive, attractive partially transparent structure to cover overhead fluorescent lamps and provide advertising space without materially detracting from the illumination provided by the lamps. Still other objects will become apparent from the more detailed description which follows.

BRIEF SUMMARY OF THE INVENTION

This invention relates to an advertising cover for use on fluorescent lighting fixtures comprising a pair of triangular end caps, two upper corner spacer members, a lower corner spacer member, and a pair of flexible transparent sheets of plastic; each said end cap having an inside surface, an outside surface, a top edge, two side edges, two upper angular corners, and a smoothly rounded lower corner forming the general shape of a triangle, a generally rectangular cutout portion extending from the central portion of the top edge toward said lower rounded corner, said two side edges having a right angle flange portion extending inwardly from said inside surface, two parallel channel recesses extending substantially the entire length of each said side edge to form an inside channel recess and an outside channel recess, and said outside recess extending around said rounded corner; a pair of horizontally slidable supporting members mounted on each side of said cutout portion adjacent said top edge, each said member having a finger extending laterally along said top edge; said upper corner spacer member being an elongated straight rod having two parallel longitudinal channel recesses to connect the respective channel recesses on the side edge or said end cap; said lower corner spacer member being an elongated trough shaped structure having the general cross-sectional shape of said rounded corner of said end cap with each edge of said structure including two parallel channel recesses to connect the respective channel recesses on the side edge of said end cap; said flexible transparent plastic sheets having an inside surface and an outside surface and being of a size to slide in the outside one of said channel recesses of said end caps, said upper corner spacer members, and said lower corner spacer member; said end cap having an elongated slotted passageway through said end cap coextensive with one inside channel recess and adapted to receive a sheet with advertising material printed thereon to slide therethrough and be retained by said inside channel recess of said end cap, said upper corner spacers, and said lower corner spacer.

In one preferred embodiment of the invention the cover is adhesively bonded together leaving a slot at each end for insertion of translucent sheets with advertising material printed thereon. In another preferred embodiment there is included a manually adjustable film strip on a carrier attached to the inside of the cover so as to provide selective prices to be shown. In still another preferred embodiment the end caps are provided with several locations for positioning the supporting members so as to permit the cover to be used with several different sizes and shapes of fluorescent lighting fixtures.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 14:
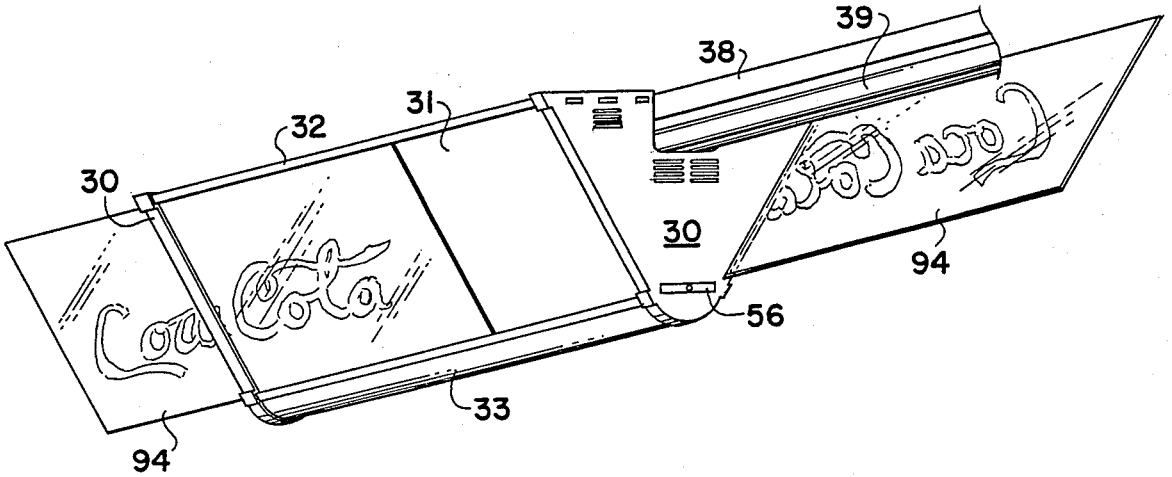
FIG. 14 is a perspective illustration of the cover of this invention attached to an overhead fluorscent strip lighting fixture with sheets of advertising material being added to the cover.

In the attached drawings there are shown views of the cover of this invention, its principal component parts, and an illustration indicating how it is used. The invention is a generally transparent cover in the form of a triangular prism which can be hung from an overhead fluorescent lighting fixture and provide advertising space backlighted by the light from the fixture. The cover is a frame which supports two large transparent plastic sheets 31. The frame includes two end caps 30, two upper corner spacer bars 32, an a lower corner spacer member 33. These seven component parts are fastened together by any suitable means, e.g., an adhesive, sonic welding, or the like, to form a triangular prism with an open top which allows the cover to be placed over a fluorescent lighting fixture including metallic raceway 38 and one or more fluorescent light bulbs 39. With this basic structure suspended around the fluorescent bulbs 39, transparent or translucent sheets 94 with advertising material printed thereon can be slid in or out of the cover to provide the selected promotional message (see FIG. 14).

Figure 3:
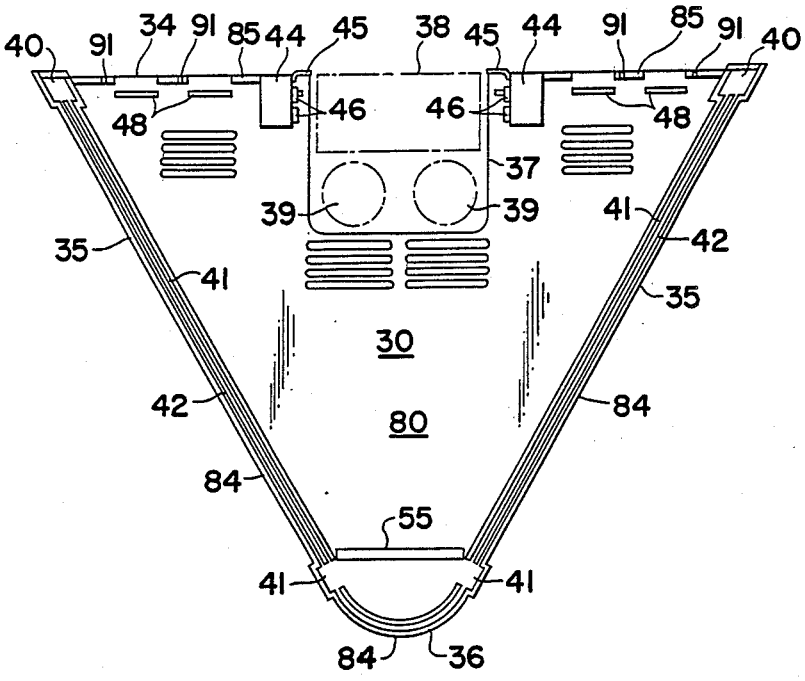
FIG. 3 is a rear elevational view of an end cap of the cover of this invention.
Figure 4:
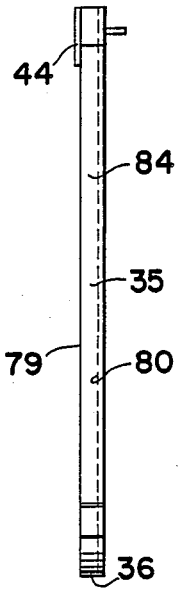
FIG. 4 is a side elevational view of the end cap of FIG. 3.
Figure 5:
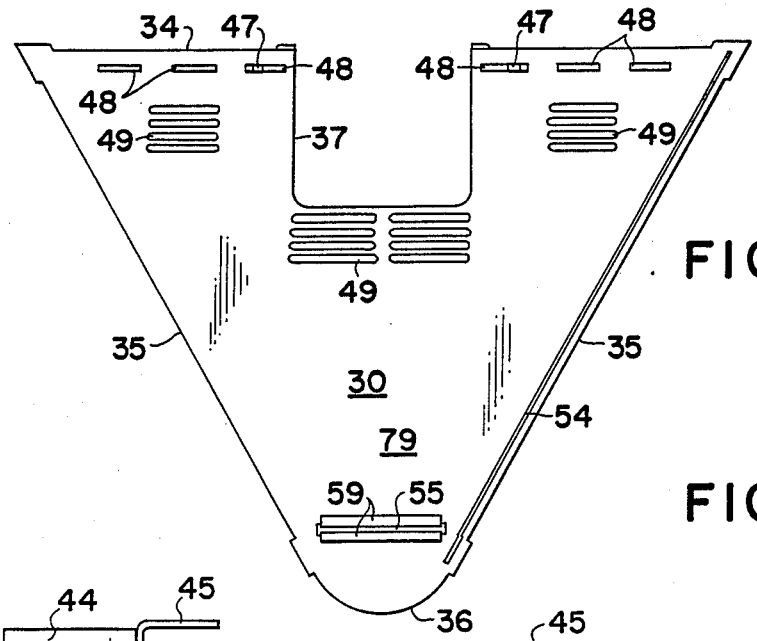
FIG. 5 is a front elevational view of the end cap of FIG. 3.
Figure 9:
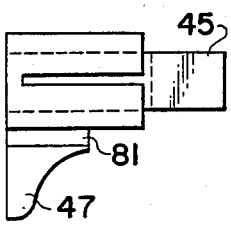
FIG. 9 is a top plan view of the member of FIG. 6.
Figure 6:
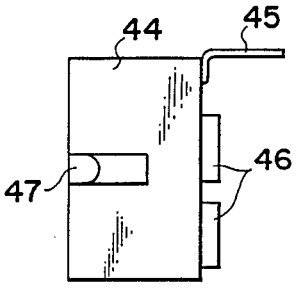
FIG. 6 is a front elevational view of the supporting member of the cover of this invention.
Figure 7:
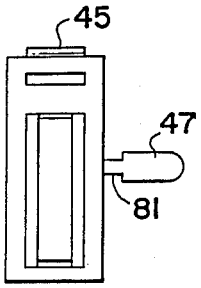
FIG. 7 is a left side elevational view of the member of FIG. 6.
Figure 8:
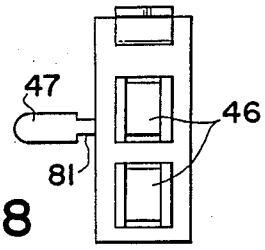
FIG. 8 is a right side elevational view of the member of FIG. 6.
Figure 15:
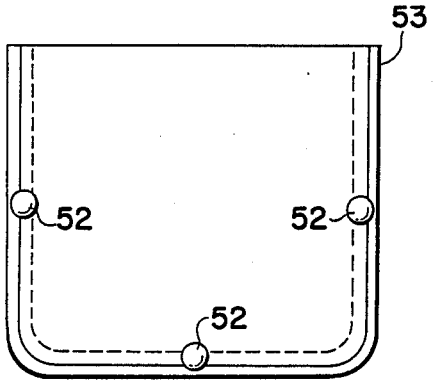
FIG. 15 is a front elevational view of a cutout cover plate for the cover of this invention.
Figure 16:
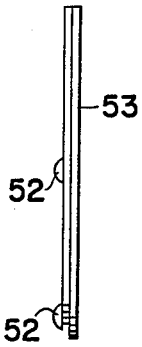
FIG. 16 is a side elevational view of the coverplate of FIG. 15.

The main component part is the end cap 30 as shown in FIGS. 3–5. The general shape of cap 30 is triangular with a top edge 34 and two side edges 35 meeting in a rounded corner 36. The triangular shape shown is equilateral, although other shapes are contemplated, such as an isosceles triangle, triangles with unequal sides, trapezoidal, rectangular, semicircular, and the like. Extending around side edges 35 and rounded corner 36 is an internally directed flange 84 to provide for stiffness and to function as a location for channel recesses 41 and 42. Channel recess 42 serves as a receiver for the lateral edges of transparent plastic sheet 31, and where it extends around rounded corner 36 it serves as a receiver for the ends of lower corner spacer number 33. Channel recess 42 does not extend across any of top edge 34 although preferably there is a flange 85 across part of top edge 34 to provide stiffness for end cap 30. In the central portion of top edge 34 is a cutout section 37 approximating the cross section shape of fluorescent lighting fixture 38 and associated lamps 39. That cross-section normally is rectangular as shown in FIG. 3. If that cutout portion 37 is not needed there is provided a cover plate as shown in FIGS. 15 and 16 having a channel perimeter as formed by bottoms 52 and inner flange 53 which may be slid into cutout portion 37 from the top to cover that open area.

End caps 30 may be transparent or opaque and are stiff inflexible structures which form the principal supporting structure of the cover. Each end cap 30 has a top edge 34, two side edges 35, an inside surface 80 and an outside surface 79. Top edge 34 of end caps 30 is in close proximity to the ceiling where fluorescent light fixture 38 and light bulbs 39 are mounted. The lower corner of end cap 30 is formed into a smoothly rounded corner 36. The entire top side of the triangular prism shaped cover is open, permitting the cover to be easily placed over any selected portion of fluorescent strip lighting and allow room for heat from the lighting to flow out between the ceiling and the top edges of the cover. However, to assist in heat removal there are a plurality of vents 49 passing through the body of end cap 30. Along each side edge 35 are two parallel channel recesses extending from the top to the bottom of each side edge 35. Inside channel recess 41 serves as a guide for a sheet of advertising material 94 and outside channel recess 42 serves as a guide to a sheet of transparent plastic 31 which is a protective cover for sheet 61.

Figure 10:
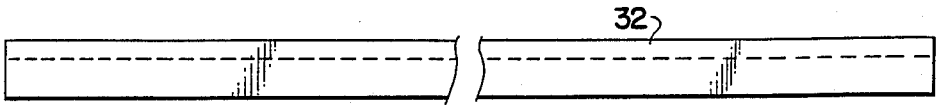
FIG. 10 is a front elevational view of the upper corner spacer of the cover of this invention.
Figure 11:
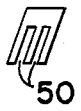
FIG. 11 is an end elevational view of the spacer of FIG. 10.
Figure 13:
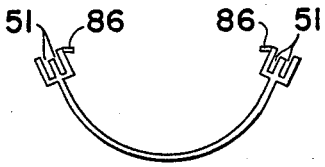
FIG. 13 is an end elevational view of the spacer of FIG. 12.
Figure 12:
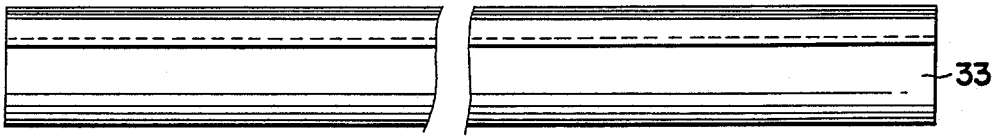
FIG. 12 is a front elevational view of the lower corner spacer of the cover of this invention.

In order to provide a solid framework to support sheets 31 and 94 the two end caps 30 are separated by two upper corner spacer bars 32 (FIGS. 10 and 11) and a lower corner spacer member 33 (FIGS. 12 and 13). These spacer bars and member fit respectively, into upper corner sockets 40 and lower corner sockets 41 of end caps 30. It will be seen that spacer bars 32 and spacer member 33 have two parallel channel recesses running the length of each (see recesses 50 in FIG. 11 and recesses 51 in FIG. 13). These channel recesses 50 and 51 match exactly with inside recess 41 and outside recess 42 of end cap 30 to form two continuous parallel channel recesses in rectangular shape so as to fit rectangular plastic sheets 31 and rectangular advertising sheets 94. For the latter there is a slotted passageway 54 through the body of each end cap 30 to permit sheet 94 to be slidably positioned into the cover of this invention after it is hung in place over a fluorescent lighting fixture 38 and bulbs 39 (see FIG. 14). Preferably, end caps 30, spacer bars 32, spacer member 33, and two rectangular plastic sheets 31 are affixed to each other by a suitable adhesive or by sonic welding. A preferred material for end caps 30 is an injection moldable, fire-retardant ABS resin. Transparent sheet 31 preferably is a polyester about 90–100 mils in thickness. Corner spacer bars 32 and spacer member 33 are preferably extruded from ABS resin matching that of end caps 30. With such materials silicone adhesive functions well to connect them together. Other suitable materials may be employed for these component parts and for the adhesive.

Figure 22:
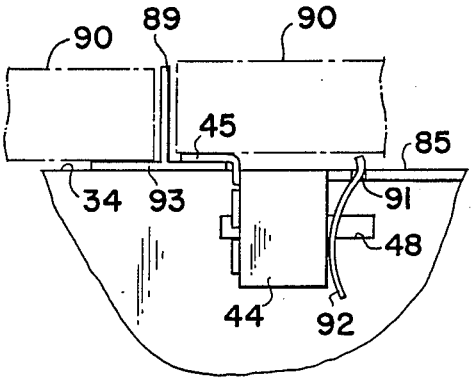
FIG. 22 is an enlarged elevational view of the cover suspended from the flange of an inverted T-bar.

In order to provide means to suspend the cover over the fluorescent lighting fixture a supporting member 44 is provided to engage raceway 38 or some other ledge adjacent the lamps 39. Along top edge 34 between corner sockets 40 and cutout section 37 there are a plurality of slots 48 into which supporting member 44 may be attached. Each member 44 has a slender finger 45 extending outwardly from the body of member 44 along its top horizontal edge. Member 44 in slot 48 is able to slide horizontally within the limits provided by slots 48. Finger 45 is adapted to slide over the top of lighting raceway 38 or alternatively over a horizontal flange of a T-bar used to support ceiling tiles, or any other nearby flange to permit the cover to be positioned over the fluorescent fixture and lamps. Generally every cover will be fitted with four such members 44 and fingers 45 which is more than adequate to support the light weight cover of this invention (normally less than 7 pounds). As a supplement or an alternate to the finger means 45, each member 44 is provided with magnet means 46, preferably one per member 44. Therefore, each end cap 30 has a pair of magnet means, 46 attached on opposing sides of cutout section 37 along the vertical edges thereof. Magnet means 46 are adapted to attach themselves magnetically to the vertical sides of metallic light fixtures 38 when member 44 is slid toward the fixture 38, thus providing support from finger 45 as well as magnet means 46. Supporting member 44 also has an outwardly projecting prong finger manipulator 47 to slide member 44 right or left as desired. Manipulator 47 has an undercut portion 81 near its base. Member 44 is attached to a slot 48 by pushing manipulator prong 47 into a selected slot 48 which snaps into attachment when prong 47 is inserted far enough into slot 48 for the compressed sides of slot 48 to snap back into place at undercut portion 81. Each member 44 may be removed from a slot 48 by pushing prong 47 in the reverse direction. A plurality of slots 48 are employed to provide flexibility in the attachment of the cover of this invention to different types of ceiling fluorescent light fixtures. Some fixtures are mounted flush in a false ceiling of tiles supported by a suspended structure of inverted T-bars. Other fixtures are mounted as strip lighting which extends for a long distance in alignment suspended below the ceiling. When the attachment is to a T-bar 89 supporting tiles 90, or other structural flange, it is preferred to employ a leaf spring 92 (see FIG. 22) depending from a slot 91 in flange 85 which urges member 44 and finger 45 into a secure hanging engagement with horizontal leg 93 of T-bar 89 or a similar flange from another overhead structure. Regardless of the type of lighting fixture or its suspension system, a plurality of slots 48 will provide the appropriate flexibility for attaching the cover of this invention thereto.

Figure 17:
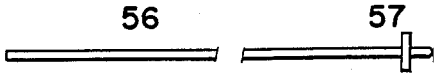
FIG. 17 is a side elevational view of the insect tray of the cover of this invention.
Figure 18:
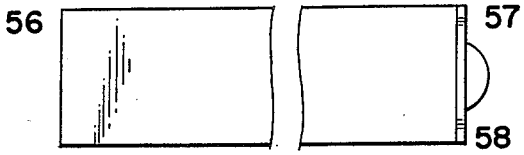
FIG. 18 is a top plan view of the tray of FIG. 17.

An optional but preferred component is an insect tray as shown in FIGS. 17 and 18. The open top of the cover against the ceiling is not tightly sealed and the cutout portions 37 do not fit tightly against the lighting fixture. Accordingly, there will be insects which congregate around the light from lamps 39 and will die and fall to the bottom of the cover of this invention. Since rounded lower corner spacer member 33 is generally translucent, the insects can be seen and will be unsightly. To provide for such an occurrence there is a tray 56 which slides lengthwise from one end cap 30 to the other end cap 30 on top of inwardly facing flanges 86 on recess member 51 of the lower corner spacer member 33 (see FIG. 13). End cap 30 has a horizontal opening 55 through which insect tray 56 may be admitted. Tray 56 has a stop flange 57 and a finger pull 58 to manipulate it into and out of cover for cleaning purposes. Preferably, end cap 30 will have a recessed step 59 around opening 55 to receive flange 57 and make it flush with the outside surface 79 of end cap 30.

Figure 1:
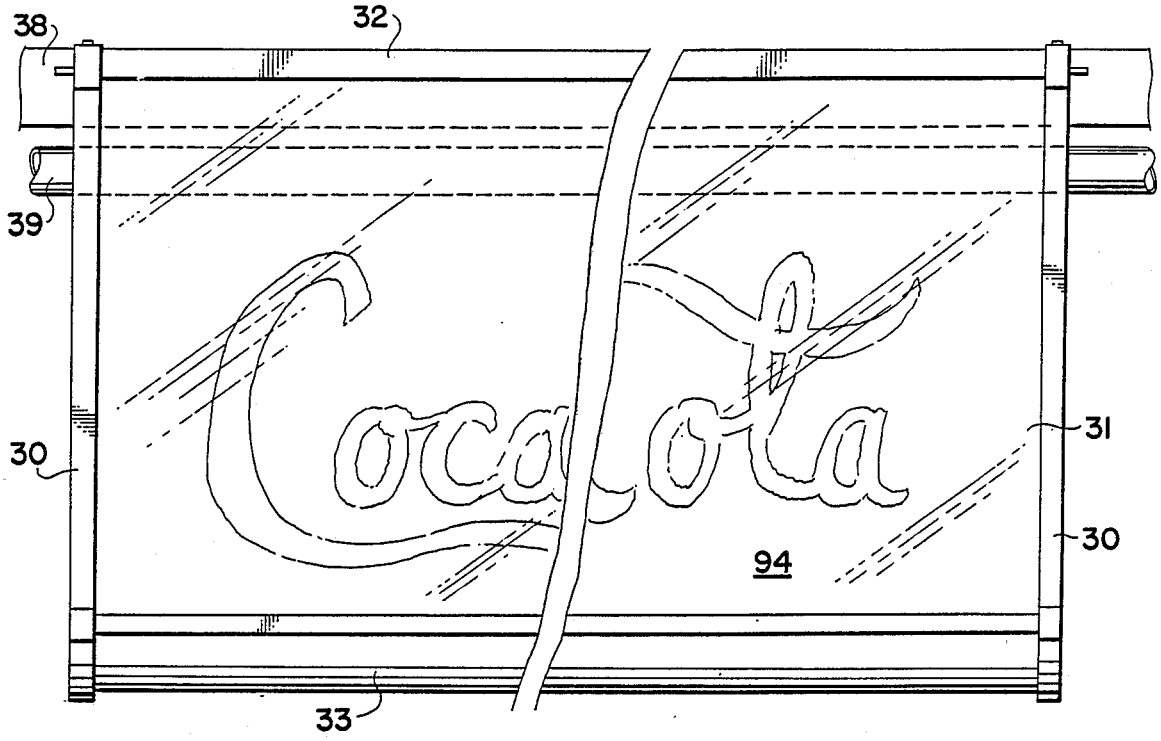
FIG. 1 is a front elevational view of the cover of this invention attached to an overhead fluorescent lighting fixture.
Figure 2:
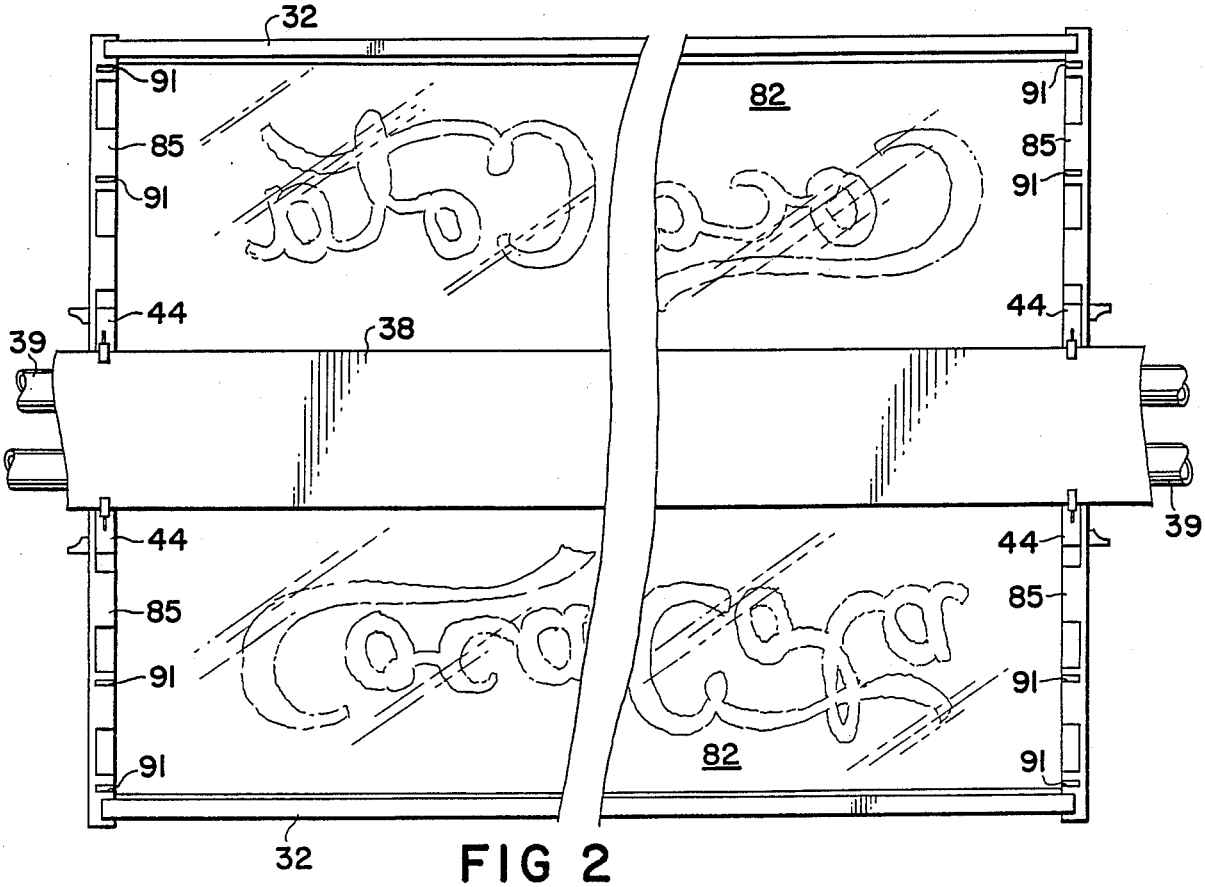
FIG. 2 is a top plan view of the cover of this invention.
Figure 19:
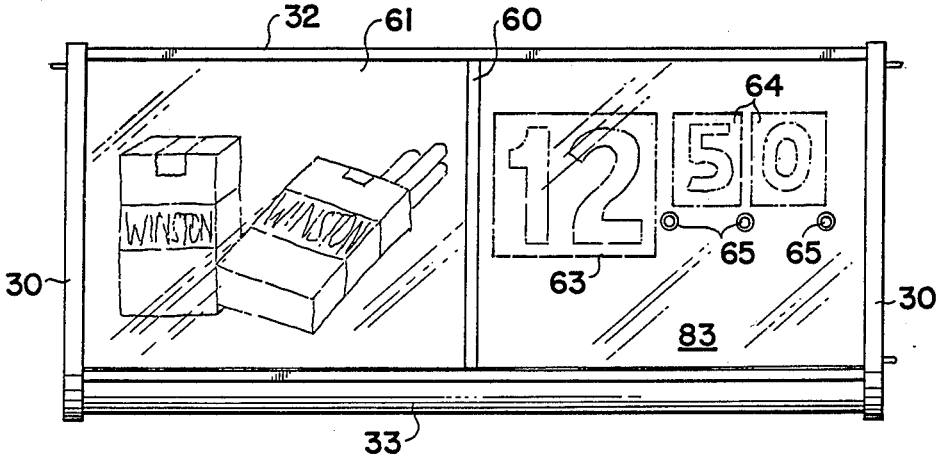
FIG. 19 is a front elevational view of the cover of this invention provided with a price panel.
Figure 20:
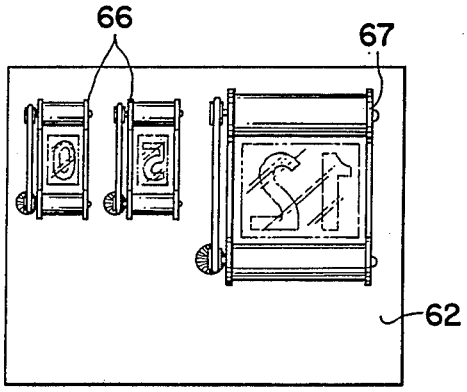
FIG. 20 is a rear elevational view of the price panel of FIG. 19.
Figure 21:
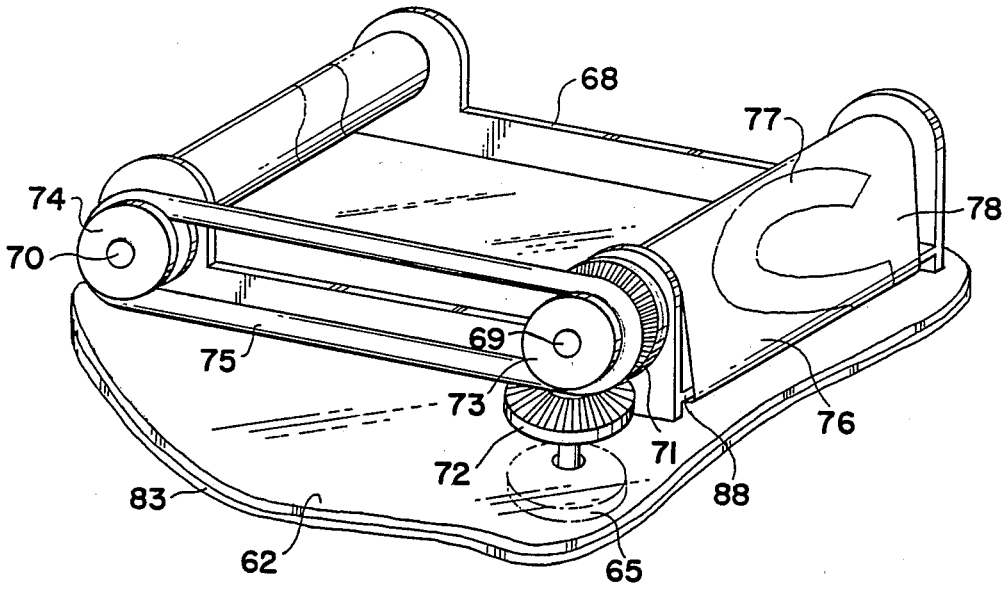
FIG. 21 is a perspective view of a manually operable price changing film strip for use on the panel of FIG. 20.

Another optional embodiment of this invention is shown in FIGS. 19–21 for the purpose of providing a price panel with a changeable pricing means. In this instance one of large plastic advertising sheets 31 is replaced by two half panel sheets 61 and 62 separated by center bar 60. Panel 61 is a transparent sheet like sheet 31 in FIGS. 1, 2 and 14; behind which a sheet of advertising material is loosely slidable in and out of its channel recesses in end cap 30, spacer bars 32, and spacer member 33, while panel 62 is designed to be permanently affixed in its position. Panel 62 is a sheet of plastic or other material to which are affixed on the backside means for showing members from a film strip which can be moved to show any desired number. A frame 75 supports two spools 69 and 70 on which is a film strip 76 which has the numbers needed to select the appropriate price. Sheet 83 is laminated over panel 62 and is opaque or darkly translucent except for transparent window portions 63 and 64 through which the numbers on the film strip 76 will be visible. Lower spool 69 has mounted thereon a bevel gear 71 and a pulley 73. Upper spool 70 has only a pulley 74 mounted thereon. A belt 75 connects pulley 73 to pulley 74 so that any rotation of spool 69 will be transmitted to the same rotation of spool 70. A mating bevel gear 72 is operatively connected to bevel gear 71. A shaft from bevel gear 72 extends through a hole in panel 62 to a finger knob 65 on the outside of panel 62 (see FIGS. 19 and, 21). Thus a person may turn knob 65 and thereby cause film strip 76 to move in either direction until the selected figure is shown. Frame 68 is translucent permitting light from the fluorescent lamp to pass through to film strip 76 and thence outwardly through window openings 63 or 64 to be seen by the customer seeing the advertising. Frame 68 is preferably adhesively affixed to panel 62 and has short legs 87 which permit film strip 76 to be threaded between the base 88 of frame 68 and the surface of panel 62. Although the FIGS. 19–21 illustrate a film strip with translucent numbers 77 against a darker opaque background 78, it is to be appreciated that such may be reversed, other information than numbers may be depicted, and other arrangements and operating devices may be employed to provide a selective movement to the numbers or other advertising components. Frames 66 are shown for small numbers and frame 67 for large numbers, but it is to be understood that other shapes and sizes are also usable.

It is to be noted that the cover of this invention is especially adapted to be attached to fluorescent strip lighting now popular in retail stores where goods are displayed on shelves along aisles where customers view the goods. The cover may readily be attached any place along the strip lighting without the necessity of any tools and without need for any special lighting or support. The cover, after being attached to the strip lighting may be slid along to any location. In this manner the raceway functions as a track over which the cover may be moved from place to place much in the same way that the light fixtures in track lighting may be moved. Either or both of the finger supports 45 or the magnet supports 46 hold the cover in attachment to the raceway while the cover is slidingly moved from place to place. The cover of this invention is adaptable to receive different advertising panels which can be inserted and removed from the cover easily. Furthermore, because this cover does not have any lighting of its own, it is not necessary to be tested for safety codes of the state where installed.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. An advertising cover for use on fluorescent lighting fixtures comprising a pair of triangular end caps, two upper corner spacer members, a lower corner spacer member, and a pair of flexible transparent sheets of plastic; each said end cap having an inside surface, an outside surface, a top edge, two side edges, two upper angular corners, and a smoothly rounded lower corner forming the general shape of a triangle, a generally rectangular cutout portion extending from the central portion of the top edge toward said lower rounded corner, said two side edges having a right angle flange portion extending inwardly from said inside surface, two parallel channel recesses extending substantially the entire length of each said side edge to form an inside channel recess and an outside channel recess, and said outside recess extending around said rounded corner; a pair of horizontally slidable supporting members mounted on each side of said cutout portion adjacent said top edge, each said member having a finger extending laterally along said top edge; said upper corner spacer members being elongated straight rods having two parallel longitudinal channel recesses to connect the respective channel recesses on the side edge of said end caps; said lower corner spacer member being an elongated trough shaped structure having the general cross-sectional shape of said rounded corner of said end cap with each edge of said structure including two parallel channel recesses to connect the respective channel recesses on the side edge of said end cap; said flexible transparent plastic sheets having an inside surface and an outside surface and being of a size to slide in the outside one of said channel recesses of said end caps, said upper corner spacer members, and said lower corner spacer member; said end cap having an elongated slotted passageway through said end cap coextensive with one inside channel recess and adapted to receive a sheet with advertising material printed thereon to slide therethrough and be retained by said inside channel recess of said end caps, said upper corner spacers, and said lower corner spacer.

2. The cover of claim 1 wherein said end caps and said flexible transparent sheet of plastic are fastened to make a unitary cover adapted to receive removable sheets of advertising material manually engageable on said inside channel recesses.

3. The cover of claim 1 wherein said fingers are adapted to extend inwardly over the top of a fluorescent strip lighting fixture or over an inverted T-bar holding ceiling tiles to support said cover thereby.

4. The cover of claim 1 which additionally comprises magnet means on said supporting member adapted to contact vertical sides of said lighting fixture.

5. The cover of claim 1 wherein said cutout portion is slightly larger than the cross section of the fluorescent strip lighting raceway and lamps to which it is attachable.

6. The cover of claim 1 wherein said lower corner spacer member is translucent.

7. The cover of claim 1 wherein said end cap has a plurality of horizontal slots therethrough adjacent said top edge spaced outwardly from said cutout portion to said upper corners respectively; and wherein said supporting members are slidably attachable to each said slot selectively.

8. The cover of claim 7 wherein each said supporting member has an outwardly projecting manipulator prong which attaches to one of said slots by being pushed therethrough to snap into an undercut groove at the base of said prong.

9. The cover of claim 1 which additionally comprises an elongated insect collector tray which extends from one said end cap to the other adjacent said rounded corner of each and is slidably removable from the outside surface of one said end cap.

10. The cover of claim 1 which additionally has removable cutout portion covers comprising a flat member having a periphery substantially the same as the periphery of said cutout portion of said end cap and having means to hold said cutout portion cover in place.

11. The cover of claim 1 which additionally comprises attached to the inside surface of said flexible transparent sheet of plastic a translucent frame and two spaced parallel rotatable spools adapted to hold a film strip thereon with a plurality of advertising information visible from outside said cover, said film strip being movable to selectively position any portion of said advertising information for visibility through said translucent frame.

12. The combination of fluorescent lighting fixture having a top and two vertical sides and an advertising cover adapted to be attached to cover said lighting fixture at any selected location, said cover comprising a pair of triangular end caps, two upper corner spacer bars, a lower corner spacer member, and a pair of flexible transparent sheets of plastic, each said end cap having an inside surface, an outside surface, a top edge, and two side edges each joined to opposite ends of said top edge and to opposite sides of said lower corner spacer member to assume the general shape of a triangle with a smoothly rounded lower corner; a generally rectangular cutout portion extending from the central portion of the top edge toward said rounded corner, said two side edges and said top edge having a right angle flange portion extending inwardly from said inside surface, two parallel channel recesses extending the entire length of said side edges and one of said recesses continuing around the rounded corner, one of said recesses along said side edge extending through said end cap to form a passageway from said outside surface to said inside surface, a pair of horizontally slidable supporting members having extendable fingers adjacent said top edge and adapted to extend over the top of a structure from which the advertising cover is to be supported, said supporting member also having magnet means adapted to contact said vertical sides of the fluorescent lighting fixture; said upper corner spacer bars being slidably connectable with said end caps by means of socket means in said end caps, and said upper corner spacer bars having two channel recesses forming extensions of said channel recesses of said end caps when joined to said socket means; said lower corner spacer member being attachable at its sides to mating sockets in said end caps and having two channel recesses extending lengthwise thereof to form extensions of said channel recesses in said end caps when joined thereto; said flexible transparent plastic sheets being of a size to slide in one of said channel recesses to said end caps, said upper corner spacer bars, and said lower corner spacer member; a pair of flexible translucent sheets having advertising matter printed thereon and adapted to be inserted through said passageway in said end cap and thence into the other of said channel recesses of said end cap, said upper corner spacer bars, and said lower corner spacer member.

13. The combination of claim 12 wherein said end caps and said flexible transparent sheet of plastic are bonded to each other along one of said channel recesses to make a unitary cover adapted to receive removable sheets of said advertising material into the other of said channel recesses.

14. The combination of claim 12 wherein said structure from which the advertising cover is to be supported is a T-bar supporting ceiling tiles adjacent said lighting fixture.

15. The combination of claim 12 wherein said lower corner spacer member is made of a translucent material and is in the form of an elongated trough with each elongated edge of said trough being a structure of two parallel channel recesses.

16. The combination of claim 12 wherein each said end cap has a plurality of slotted passageways extending lengthwise parallel to and adjacent to said top edge.

17. The combination of claim 16 wherein said supporting member includes an outwardly projecting manipulator prong which is adapted to snap into one of said slots manually and selectively.

18. The combination of claim 12 which additionally includes an insect collector tray which is slidably mounted in one said end cap and extends to adjacent the other said end cap.

19. The combination of claim 12 which additionally comprises a translucent frame attached to the inside of said flexible transparent plastic sheet, an opaque cover sheet with a window therein, two rotatable spools, finger means outside said cover to rotate said spools and a film strip mounted on said spools and containing advertising material adapted to be positioned over said window to be seen from outside said cover.

20. The combination of claim 12 wherein said end cap includes a plurality of passageways therethrough adjacent said cutout portion and adapted to promote air flow through said passageways to cool the interior of said cover.

21. An advertising cover for use on fluorescent lighting fixtures comprising a pair of triangular end caps, two upper corner spacer members, a lower corner spacer member, and a pair of flexible transparent sheets of plastic; each said end cap having an inside surface, an outside surface, a top edge, two side edges, two upper angular corners, and a smoothly rounded lower corner forming the general shape of a triangle, a generally rectangular cutout portion extending from the central portion of the top edge toward said lower rounded corner, said two side edges having a right angle flange portion extending inwardly from said inside surface, two parallel channel recesses extending substantially the entire length of each said side edge to form an inside channel recess and an outside channel recess, and said outside recess extending around said rounded corner; means for suspending said cover from above with said lighting radiating light from inside to outside said cover through said sheets of plastic; said upper corner spacer members being elongated straight rods having two parallel longitudinal channel recesses to connect the respective channel recesses on the side edge of said end caps; said lower corner spacer member being an elongated trough shaped structure having the general cross-sectional shape of said rounded corner of said end cap with each edge of said structure including two parallel channel recesses to connect the respective channel recesses on the side edge of said end caps; said flexible transparent plastic sheets having an inside surface and an outside surface and being of a size to slide in the outside one of said channel recesses of said end caps, said upper corner spacer members, and said lower corner spacer member; and means for positioning transparent advertising material adjacent to said sheets of plastic with said radiating light passing therethrough.

* * * * *